United States Patent [19]

Kozacka

[11] 4,179,071

[45] Dec. 18, 1979

[54] INDUSTRIAL SULFUR TRIOXIDE GAS INJECTION PROBE AND METHOD OF MANUFACTURE

[75] Inventor: Wayne R. Kozacka, Laguna Hills, Calif.

[73] Assignee: Wahlco, Inc., Santa Ana, Calif.

[21] Appl. No.: 922,770

[22] Filed: Jul. 7, 1978

[51] Int. Cl.[2] ..... B05B 1/14; B32B 31/06

[52] U.S. Cl. ..... 239/397.5; 29/157.1 R; 29/455 R; 138/149; 239/559; 239/567; 264/262

[58] Field of Search ..... 239/397.5, 556–559, 239/567, DIG. 19; 422/168–170, 172, 182, 194; 29/455 R, 157.1 R; 423/532–538; 55/101, 128, 267, 476; 138/149, 177; 264/261, 262

[56] References Cited

U.S. PATENT DOCUMENTS 3,286,343 11/1966 Alfille et al. ..... 29/455 R

*Primary Examiner*—Robert B. Reeves
*Assistant Examiner*—Andres Kashnikow
*Attorney, Agent, or Firm*—Howard E. Sandler

[57] ABSTRACT

An industrial sulfur trioxide ($SO_3$) gas injection probe and method of manufacture, and more particularly an $SO_3$ gas injection probe for injecting $SO_3$ into a gaseous stream having improved structural and insulating characteristics and a simplified method of manufacture.

7 Claims, 2 Drawing Figures

INDUSTRIAL SULFUR TRIOXIDE GAS INJECTION PROBE AND METHOD OF MANUFACTURE

Figure 1:
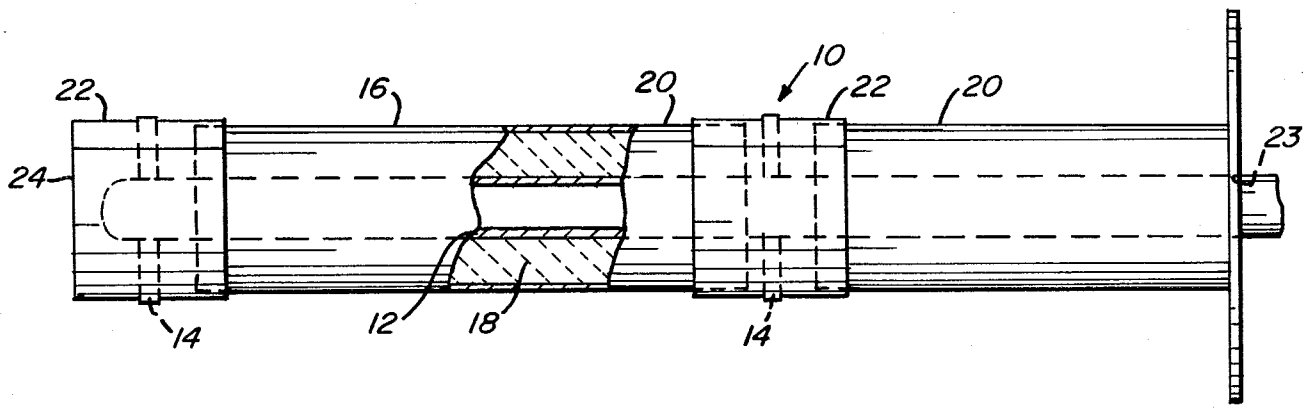

Sulfur is burned and catalytically converted to produce $SO_3$ gas as a reactant in many chemical processes, for example in flue gas conditioning systems as described in U.S. Pat. No. 3,993,429 which is assigned to the same assignee as is this invention. In this example, as well as other applications, the $SO_3$ gas must be maintained at a temperature above the dew point thereof, approximately 500° F., from the point of conversion to the point of injection as a chemical reactant. Should the $SO_3$ gas stream drop substantially below 500° F. before subsequent reaction, condensation and the formation of sulfuric acid ($H_2SO_4$) will occur. In this latter event a significant quantity of $H_2SO_4$ may be expelled from the injection nozzles which can result in a variety of deleterious effects, for example; corrosion, undesirable chemical reactions, process breakdown and the like. This problem is further amplified in industrial applications of $SO_3$ gas injection probes wherein the $SO_3$ gas may exit from the catalytic converter at approximately 600° F. and must then travel through a relatively long probe, for example 6 to 30 feet, to the final discharge nozzle at the free end of the probe.

Industrial $SO_3$ gas injection probes must additionally be resistant to corrosion and have means therein to provide for thermo expansion because of the corrosive and high temperature usages thereof. Heretofore such probes were manufactured by initially fabricating a stainless steel pipe with lateral nozzle extensions and thereafter covering the pipe with a wrap around thermal pipe insulation. This thermal pipe insulation is, in practice, of non uniform dimensions which may vary substantially (i.e. $\pm\frac{1}{2}''$ in finished diameter). The pipe insulation was now covered with an exterior metal sheathing with slip joints to permit thermal expansion. Because of the irregularity of the diameter of the pipe insulation, the sheathing was required to be formed in place and then welded at longitudinal seams. This fabrication requirement not only is time consuming but may result in a variety of other problems, for example; irregular insulating characteristics, potential of failure at the longitudinal welds and a greater potential of binding at the slip joints during thermal expansion or contraction.

By means of the present invention which includes an industrial $SO_3$ gas injection probe wherein the pipe, nozzles, sheathing and slip joints are first fabricated and thereafter a pourable lightweight refractory material is poured within the assembly and allowed to set, the hereinabove mentioned problems of prior industrial $SO_3$ gas injection probes is overcome or, in the least, greatly alleviated. Specifically: the insulation is now of a uniform diameter and the propensity of irregular insulating characteristics is substantially reduced; if desired, the sheathing rather than being wrapped in place to size, may be a seamless stainless steel pipe or, in the least, may be a seamed pipe which is fabricated of a uniform outer diameter and under more controlled conditions; because there is no irregularity in the outer diameter of the sheathing, the propensity to bind at the slip joints is substantially reduced; and the like.

Accordingly, it is one object of this invention to provide an $SO_3$ gas injection probe having uniform insulating characteristics and a uniform outer diameter.

It is another object of this invention to provide an improved method of fabrication of an industrial $SO_3$ gas injection probe.

Figure 2:
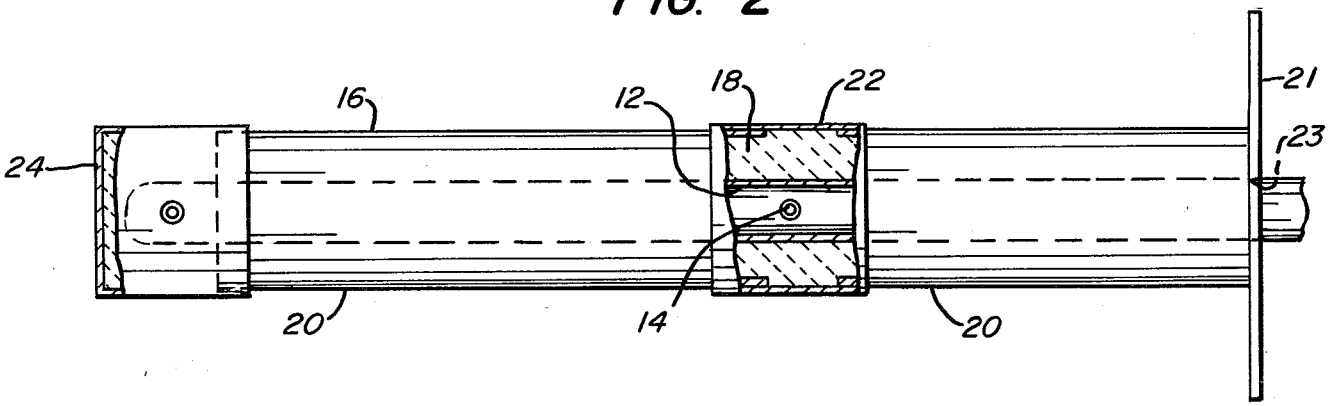

These and other objects and advantages of the present invention will become more readily apparent upon a review of the following description and drawings in which:

FIG. 1 is a longitudinal side elevational view, partially in section, of an industrial $SO_3$ gas injection probe constructed in accordance with the principles of the present invention; and FIG. 2 is a view of the injection probe of FIG. 1 rotated ninety degrees about the longitudinal axis thereof.

Referring to FIGS. 1 and 2, there is illustrated an industrial sulfur trioxide ($SO_3$) gas injection probe 10 of the present invention which comprises: an elongated gas conveying pipe 12; a plurality of sets of gas injection nozzles 14 which are carried by pipe 12, are longitudinally spaced with respect to the longitudinal axis of pipe 12 and extend transversely outwardly with respect thereto; a longitudinally extending sheathing assembly 16 which is coaxial with respect to pipe 12 and has the inner periphery thereof spaced radially outwardly with respect to the outer periphery of pipe 12; and refractory 18 which is disposed intermediate the adjacent peripherial surfaces of pipe 12 and assembly 16.

The probe 10 of this invention is of a type to be utilized in industrial applications, for example, for insertion in a boiler flue which conveys flue gas to an electrostatic precipitator for flyash removal. In such an application wherein the length requirements for the probe 10 may vary from 6 to 30 feet, gaseous $SO_3$ is passed from an upstream source into the probe 10 and is discharged therefrom through nozzles 14 to treat the flue gas stream in a manner that the resistivity of the flyash therein will be compatable with the efficient removal requirements of the downstream electrostatic precipitator. Such an application for an $SO_3$ injection probe such as probe 10 of the present invention, is fully described in U.S. Pat. No. 3,993,429.

The atmosphere within which the probe 10 is utilized as well as the $SO_3$ carried thereby may be quite corrosive. Accordingly, in the preferred embodiment of this invention all materials of probe 10 are to be corrosive resistant, for example, the metalic portions of probe 10 are to be of stainless steel and the refractory 18 is to be relatively chemically inert after hardened. Furthermore, the probe 10 must have the ability to insulate the gaseous $SO_3$ carried therein in a manner that through the travel of the $SO_3$ therein, the temperature of such gas does not fall below the dew point thereof. For example, with a system such as illustrated in U.S. Pat. No. 3,993,429, it is anticipated that the gaseous $SO_3$ will enter the probe 10 at 600° F. Assuming a boiler exhaust flue temperature of 300° F., the composition and physical structure of the refractory 18 should be such that the $SO_3$ therein will remain above 500° F. prior to discharge.

As shown, sheathing assembly 16 comprises a plurality of axially aligned and spaced hollow annular tubular portions 20. The most rearward (to the right in FIGS. 1 and 2) end of portion 20 includes a transversely extending mounting flange 21 secured thereto. In operation flange 21 is secured to a support member, such as a wall of a boiler flue, (not shown), and the balance of probe 10 is inserted through a suitable opening formed within the support member. Flange 21 includes a coaxial bore 23 therethrough, through which a rear end portion of pipe 12 projects for connection to the gaseous $SO_3$ source.

An expansion member 22 is disposed intermediate adjacent axially spaced portions 20. Expansion member 22 is of any suitable configuration and, as shown, is formed as a sleeve having an inner diameter of a size which will slidably receive axial end sections of portions 20 therewithin. In assembled position, one axial end of expansion member 22 receives an axial end section of portion 20 therewithin and is firmly secured thereto adjacent the outer periphery thereof, such as by welding or the like. The other axial end of expansion member 22 slidably receives an axial end section of the adjacent portion 20 therewithin, thereby providing a configuration which permits a degree of movement of sheathing assembly 16 to compensate for thermal expansion and contraction. An additional expansion member 22 is provided adjacent the forwardmost or free end of sheathing assembly 16. An end cap 24 is affixed to the forwardmost end of the forward expansion member 22 to complete the enclosure of probe 10.

In assembled position nozzles 14 communicate between the interior of pipe 12 and the exterior of expansion members 22 in a manner that the radially innermost portions of nozzles 14 are received and carried within transverse bores through pipe 20 and the radially outermost portions thereof extended through radially aligned openings within respective expansion members 22. Thus, $SO_3$ gas will flow from the source (not shown) through gas conveying pipe 12 and be discharged from probe 10 via nozzles 14.

In manufacturing a gas injection probe 10 of the present invention, the following method is utilized:

(A) The sheathing assembly with the pipe therein and nozzles extending therebetween is fabricated as illustrated, except either the end cap 24 or the flange 21 is not positioned.

(B) The fabricated subassembly is positioned vertically and a suitable pourable refractory is poured within the open end to completely fill the annular space between the sheathing assmebly 16 and the pipe 12.

(C) The refractory is permitted to set and the end cap 24 or the flange 21, whichever was left off of the subassembly, is secured in position thereby completing the manufacture of probe 10.

The above method of manufacture as well as the resulting structure therefrom will thus obtain the desired advantages over the prior art industrial $SO_3$ gas injection probes by assuring more consistant; thermal insulating characteristics, expansion and contraction, uniformity and durability.

The embodiment described herein is the presently preferred embodiment of an industrial $SO_3$ gas injection probe constructed in accordance with the principles of the present invention; however, it is to be understood that various modifications may be made to the embodiment described herein by those knowledgeable in the art without departing from the scope of the invention as is defined by the claims set forth hereinafter. For example: tubular portions 20 may be constructed of seamless thin wall pipe or may be fabricated as a weldment; nozzles 14 may extend between pipe 12 and tubular portions 20 rather than between pipe 12 and expansion member 22; alternative sheathing expansion arrangements are anticipated; more than two tubular portions 20 may be utilized; should conditions dictate, only a single tubular portion 20 may be utilized; and the like.

I claim:

1. An industrial sulfur trioxide gas injection probe comprising: an elongated outer metallic sheathing portion; an elongated sulfur trioxide gas conveying pipe having at least a major portion thereof received within said sheathing portion; the outer diameter of said conveying pipe being less than the inner diameter of said sheathing portion; a refractory disposed intermediate the adjacent peripheral surfaces of said pipe and said sheathing portion; said refractory being disposed between said adjacent surfaces as a poured refractory and thereafter being allowed to set up to uniformly fill the space between said adjacent surfaces; the outer diameter of said refractor and the outer diameter of said sheathing portion being constant through the respective major longitudinal extents thereof; and a plurality of longitudinally spaced generally transversely extending sulfur trioxide gas injection nozzles communicating between the interior of said pipe and the exterior of said sheathing portion.

2. An injection probe as specified in claim 1 wherein said sheathing portion and the portion of said pipe received therein are coaxial.

3. An injection probe as specified in claim 2 additionally including at least another sheathing portion in coaxial alignment with said first mentioned sheathing portion and longitudinally spaced therefrom.

4. An injection probe as specified in claim 3 with a longitudinal expansion means disposed intermediate said first and said another sheathing portions to allow relative longitudinal movement of at least one of said portions with respect to the other of said portions.

5. An injection probe as specified in claim 4 with said conveying pipe having at least one portion thereof coaxially received within said first mentioned and another sheathing portions and said expansion means.

6. A method of manufacturing an industrial sulfur trioxide gas injection probe having an elongated outer metallic sheathing and an elongated gas conveying pipe with at least a major longitudinal portion of said pipe received within said sheathing and with a plurality of longitudinally spaced transversely extending injection nozzles communicating between the interior of said pipe and the exterior of said sheathing comprising the steps of: fabricating a sub-assembly of said sheathing, said pipe and said nozzles, with one end of said sub-assembly being open; maintaining an annular space between adjacent peripherial surfaces of said pipe and said sheathing; orientating said sub-assembly in a substantially vertical position; pouring a castable refractory within said one end of said sub-assembly; and sealing said one end of said sub-assembly.

7. A method as specified in claim 6 wherein during said fabricating, said sheathing and said pipe are coaxially maintained.

* * * * *